US011661223B2

(12) United States Patent
Beck et al.

(10) Patent No.: US 11,661,223 B2
(45) Date of Patent: May 30, 2023

(54) METHOD AND DEVICE FOR PRODUCING A PACKAGING BODY OF PACKAGING

(71) Applicant: Syntegon Technology GmbH, Waiblingen (DE)

(72) Inventors: Martin Beck, Pluederhausen (DE); Ruediger Karcher, Lorch (DE); Hans-Peter Stadel, Lorch (DE); Ulrich Wieduwilt, Schwaebisch Gmuend (DE); Uwe Stroinski, Waiblingen (DE)

(73) Assignee: Syntegon Technology GmbH, Waiblingen (DE)

( * ) Notice: Subject to any disclaimer, the term of this patent is extended or adjusted under 35 U.S.C. 154(b) by 111 days.

(21) Appl. No.: 17/440,223

(22) PCT Filed: Mar. 16, 2020

(86) PCT No.: PCT/EP2020/057018
§ 371 (c)(1),
(2) Date: Sep. 17, 2021

(87) PCT Pub. No.: WO2020/207703
PCT Pub. Date: Oct. 15, 2020

(65) Prior Publication Data
US 2022/0153463 A1 May 19, 2022

(30) Foreign Application Priority Data
Apr. 11, 2019 (DE) ..... 10 2019 205 172.3

(51) Int. Cl.
*B65B 47/04* (2006.01)
*B65B 9/04* (2006.01)
(Continued)

(52) U.S. Cl.
CPC ..... *B65B 47/04* (2013.01); *B31F 1/0077* (2013.01); *B65B 9/04* (2013.01); *B65B 41/10* (2013.01); *B65B 41/14* (2013.01); *B65B 47/08* (2013.01)

(58) Field of Classification Search
CPC ..... B65B 9/04; B65B 9/045; B65B 41/04; B65B 41/10; B65B 41/14; B65B 47/04;
(Continued)

(56) References Cited

U.S. PATENT DOCUMENTS 2,736,150 A * 2/1956 Loew ..... B29C 51/18 53/548
2,948,998 A * 8/1960 Pfeiffer ..... B29C 51/28 53/559
(Continued)

FOREIGN PATENT DOCUMENTS

DE 4135935 A1 5/1993
DE 202016007676 U1 1/2018
(Continued)

OTHER PUBLICATIONS

Translation of International Search Report for Application No. PCT/EP2020/057018 dated Aug. 24, 2020 (3 pages).
(Continued)

*Primary Examiner* — Stephen F. Gerrity
(74) *Attorney, Agent, or Firm* — Michael Best & Friedrich LLP

(57) ABSTRACT

A method for producing a packaging body (51) from a web material that comprises paper, wherein the packaging body (51) comprises an indentation (53) for receiving an item to be packaged, the method comprising: pre-tensioning the web material (14); fixing the web material (14) between a holding-down device (32) and a die (31); molding the
(Continued)

indentation (53) in the web material (14); and removing the molded indentation (53) from the die (31).

9 Claims, 4 Drawing Sheets

(51) Int. Cl.
*B65B 41/14* (2006.01)
*B65B 47/08* (2006.01)
*B65B 41/10* (2006.01)
*B31F 1/00* (2006.01)

(58) Field of Classification Search
CPC ..... B65B 47/08; B65H 20/16; B65H 20/18; B31F 1/0077
USPC ..... 53/453, 559
See application file for complete search history.

(56) References Cited

U.S. PATENT DOCUMENTS 3,385,025 A * 5/1968 Lemelson ..... B65B 3/02 53/559
3,509,683 A 5/1970 Sternau
3,766,702 A * 10/1973 Meissner et al. ..... B29C 51/00 53/559
3,948,017 A 4/1976 Faller
4,287,702 A * 9/1981 Corbic ..... B65B 9/042 53/559
4,329,830 A * 5/1982 Omori ..... B65B 9/042 53/453
4,490,963 A * 1/1985 Knudsen ..... B65B 9/045 53/559
4,708,301 A * 11/1987 Kataoka ..... B65H 20/16 226/44
5,802,821 A * 9/1998 Albrecht ..... B65B 7/164 53/51
6,101,790 A * 8/2000 Mori et al. ..... B65B 15/04 53/559
7,607,281 B2 * 10/2009 Freddi ..... B65B 7/164 53/553

FOREIGN PATENT DOCUMENTS

EP 0408874 A2 1/1991
EP 0431392 A1 6/1991
JP 60067354 A * 4/1985 ..... B65H 20/16
JP 2002001840 A * 1/2002
WO 2009024830 A1 2/2009
WO 2013053484 A1 4/2013
WO 2019011448 A1 1/2019

OTHER PUBLICATIONS

International Preliminary Report on Patentability for Application No. PCT/EP2020/057018 dated Sep. 28, 2021 (8 pages).
European Patent Office Extended Search Report for Application No. 22162931 dated Jul. 22, 2022 (11 pages, including partial machine translation).

* cited by examiner

METHOD AND DEVICE FOR PRODUCING A PACKAGING BODY OF PACKAGING

BACKGROUND

The present invention relates to a device and a method for producing a packaging body of packaging, wherein the packaging body comprises an indentation for receiving an item to be packaged and is produced from a web material made of paper.

In the case of packaging made of plastics material, for example in the case of packaging for foodstuffs, it is known that a packaging body is produced from a roll web, for example by means of deep drawing, which packaging body is then closed with a cover film from another roll web. Molding the packaging body roll web into the actual packaging body can be carried out in different molding steps. For example, it is possible to pull the roll material freely into a cavity, but this leads to increased wrinkling on the packaging body. Alternatively, the packaging body roll web is fixed, before the actual molding process, along an edge of a cavity to be formed, but this leads to limited mold depths and likewise to wrinkling, albeit lighter, but still present. Furthermore, a molding process with a punch and die as well as a holding-down means is also known in principle, in which method the roll web material can slip in a controlled manner during the molding step. In this way, in particular, a greater mold depth can be achieved and the wrinkling can be reduced. These methods are mainly used for plastics-based roll webs.

From an environmental point of view, however, more and more attempts have recently been made to produce packaging from materials that are as recyclable as possible, such as paper materials. In this case, only paper materials can be used here or, for example, composite materials which consist of a paper material coated with plastics material. However, materials of this type that comprise paper are relatively difficult to mold or, during the molding, undesired wrinkles and microcracks occur, which can lead to damage to the packaging body. It would therefore be desirable to have a method and a device which allows roll webs that comprise paper to be reliably molded.

WO 2009/024830 A1 discloses a method for producing a packaging body of packaging.

SUMMARY

The method according to the invention for producing a packaging body from a roll web material that comprises paper, comprising an indentation for receiving an item to be packaged has the advantage that it is possible to mold the web material without wrinkles. In particular, in addition to preventing the formation of wrinkles, microcracks and microwrinkles can also be prevented in the packaging body. This is achieved according to the invention in that the method proposes a first step of pre-tensioning the web material and a subsequent step of fixing the web material between a holding-down means and a die. The indentation is then molded in the web material and the molded indentation is removed from the die. The indentation is introduced into the web material and the packaging body produced in this way is not yet separated from the web material. This allows easy onward transport. The web material preferably exclusively comprises paper, in particular without any plastics material.

According to the invention, the step of pre-tensioning the web material is carried out by means of clamping jaws arranged laterally on the web material and a tension roller means having two rollers, between which the material web is fixed. The web material can thus be tensioned transversely to the transport direction by the clamping jaws and also in the transport direction by the tension roller means. This makes it possible to ensure that, as a result of the pre-tensioning of the web material, there are no wrinkles in the web material before the step of molding the indentation. This also significantly reduces the potential for wrinkles or the like to occur in the molding step.

Particularly preferably, the clamping jaws for the pre-tensioning step are set up such that they also allow the web material to be transported forward in the transport direction.

More preferably, after the web material has been pre-tensioned, a step of stretching the pre-tensioned web material is also carried out. The stretching can preferably be carried out by means of the clamping jaws and the tension roller means, in particular in the transport direction.

According to a further preferred embodiment of the invention, the step of molding the web material is carried out in two stages with a pre-molding step and a final molding step. As a result, excessive stress on the web material and thus possible tearing can be avoided during the molding step.

A third molding step is also preferably provided, which embosses fine structures in the molded packaging body. This embossing step is carried out after the final molding step.

The pre-molding step is preferably carried out by means of compressed air. The final molding step is more preferably carried out by means of compressed air or by means of a punch. Even more preferably, the embossing step is carried out by means of compressed air. With regard to the molding steps carried out using compressed air, it should be noted that this is preferably carried out on the web material from a side opposite a die in order to press the web material into the die.

More preferably, during the molding step, the holding-down means is brought into a position in which web material can be fed. In particular, this prevents microcracking in the molded packaging body.

According to a further preferred embodiment of the invention, the pre-tensioning step is carried out such that the web material is smoothed before the molding step. As a result, the web material has no wrinkles owing to the pre-tensioning, which leads to particularly good smoothing of the web material.

The present invention further relates to a device for producing a packaging body comprising an indentation for receiving a packaged item from a web material that comprises paper. The device comprises a pre-tensioning means, a molding means having a die and a holding-down means, and a pressure generating means for generating a pneumatic molding pressure. Furthermore, a removing device is provided for removing the molded indentation from the die. The indentation is preferably provided such that web material still surrounds the indentation. This in particular significantly simplifies further handling.

In addition to the die and the holding-down means, the molding means preferably also comprises a punch. The punch is used in particular in a two-stage molding step for producing the finished mold.

According to the invention, the pre-tensioning means comprises clamping jaws and a tension roller means having at least two rollers. The web material is passed through the two rollers of the tension roller means. This allows pre-tensioning both in the transport direction and transversely to the transport direction. The clamping jaws are also preferably used to transport the web material forward.

Furthermore, the device for producing the packaging body preferably also comprises a control unit which is set up to bring the holding-down means into a position in which web material can be fed during the molding step. This significantly reduces wrinkling during the step of molding the packaging body. Alternatively, the molding step can also be carried out without feeding web material with the holding-down means lowered.

BRIEF DESCRIPTION OF THE DRAWINGS

A preferred embodiment of the invention is described in detail below with reference to the accompanying drawings, in which.

DETAILED DESCRIPTION

Figure 1:
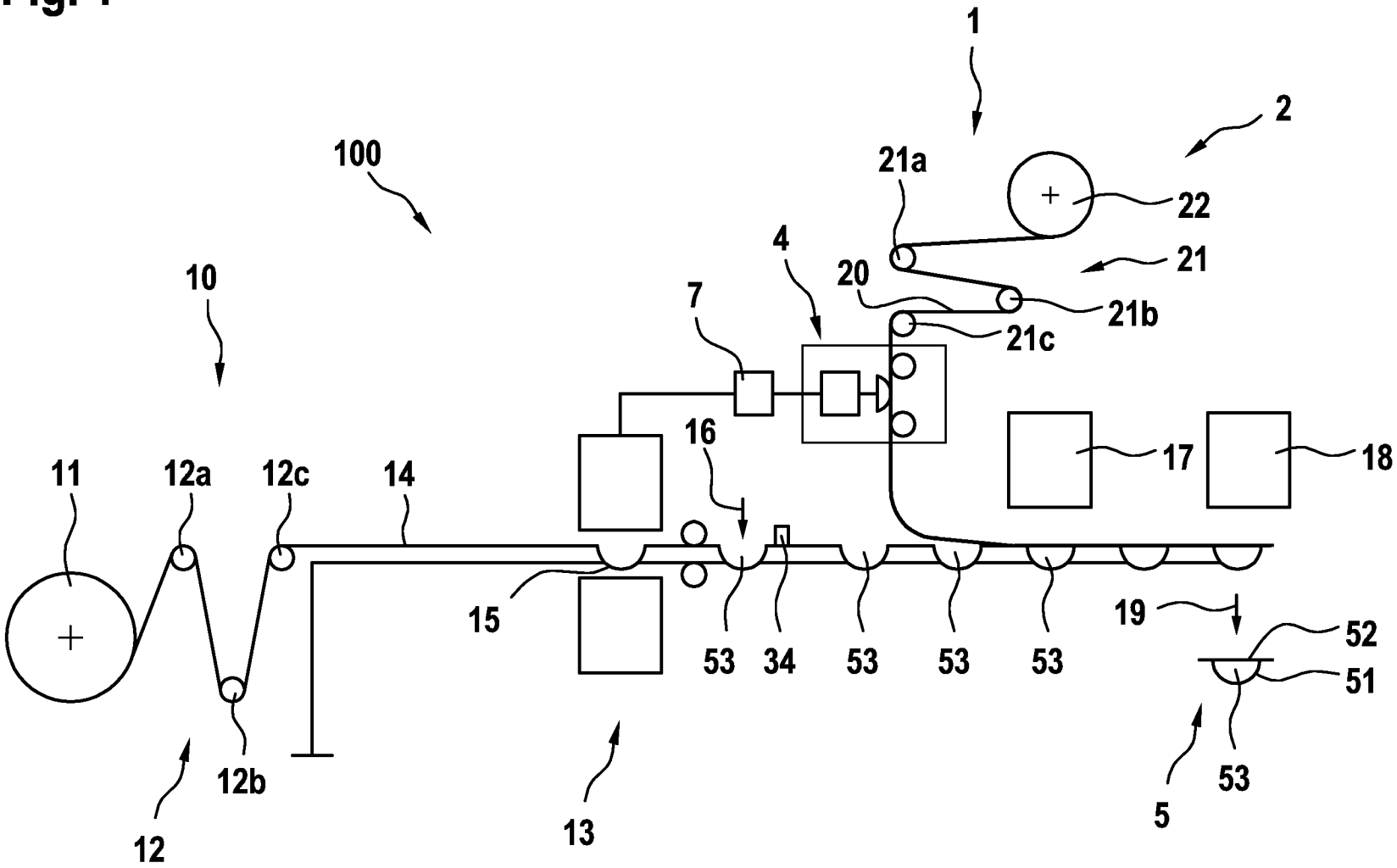
FIG. 1 shows a schematic view of a device for producing and filling packaging with a device for producing a packaging body according to a preferred embodiment of the invention.

In the following, with reference to FIGS. 1 to 6, a device 10 for producing a packaging body 51 comprising an indentation 53 for receiving an item to be packaged from a web material 14 is shown. The web material 14 comprises paper and is preferably made entirely of paper.

The device 10 is part of a packaging machine 100 which, in addition to the device 10 for producing the packaging body 51, also has a device 1 for processing a cover roll web 20 made of paper. The cover roll web 20 is a cover web of the packaging and forms a lid 52 on the finished packaging 5.

The device 1 for processing the cover roll web 20 comprises a draw-off device 2 which draws off the cover roll web from a continuous roll 22. The drawing-off is continuous. The draw-off device 2 further comprises a dancer roller arrangement 21 having three rollers 21*a*, 21*b*, 21*c*. The dancer roller arrangement 21 allows the cover roll web to be continuously drawn off from the roller 22; it is nevertheless possible to process of the cover roll web 20 at a standstill. Such processing can be carried out, for example, by means of a stretching device 4 in order to stretch the cover web.

The device 10 for producing the packaging body 51 comprising the indentation 53 has, like the cover web, a continuous roll 11 and a dancer roller arrangement 12 having three rollers 12*a*, 12*b* and 12*c*. This dancer roller arrangement 12 also allows the web material 14 to be drawn off continuously from the continuous roll 11, wherein the web material can then be stopped intermittently during the further processing of the web material 14 and various work steps can be carried out.

The device 10 for producing the packaging body 51 comprises a pre-tensioning means 3, a molding means 13, a pressure generating means for generating a pneumatic molding pressure, and a removing device for ejecting the produced packaging body 51 from the molding device.

Figure 2:
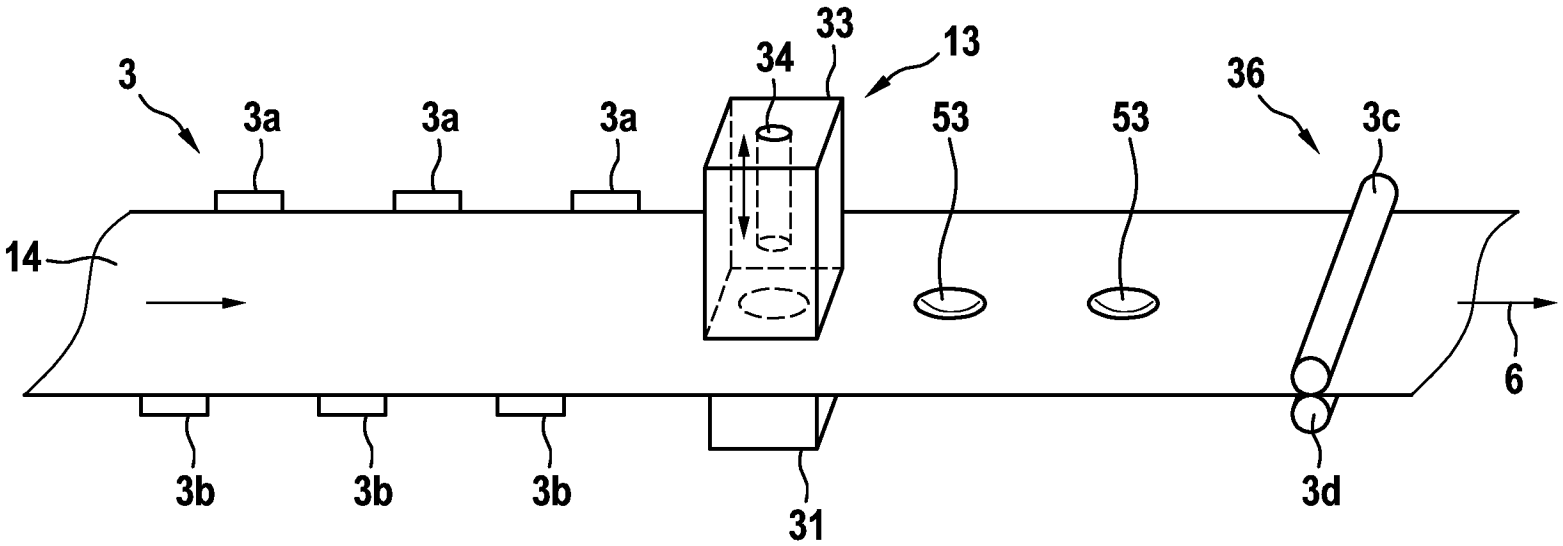
FIG. 2 shows a schematic plan view of a pre-tensioning means of the device of FIG. 1.
Figure 3:
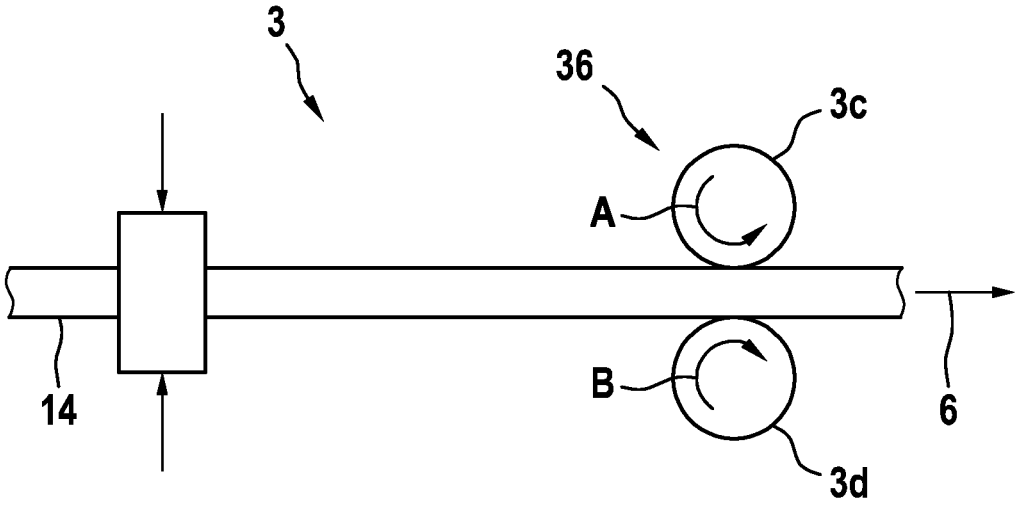
FIG. 3 shows a schematic side view of the pre-tensioning device of FIG. 2 and FIGS. 4 to 6 show schematic representations of a molding means, with various steps of the molding being shown.

The pre-tensioning means 3 can be seen in detail from FIGS. 2 and 3. The pre-tensioning means 3 comprises a plurality of clamping jaws 3*a* and 3*b* and a tension roller means 36 having a first roller 3*c* and a second roller 3*d*. The web material 14 is passed between the two rollers 3*c* and 3*d*. Here, the packaging body 51 is later formed on the portion in the transport direction 6 between the clamping jaws 3*a* and 3*b* and the rollers 3*c* and 3*d*.

Figure 4:
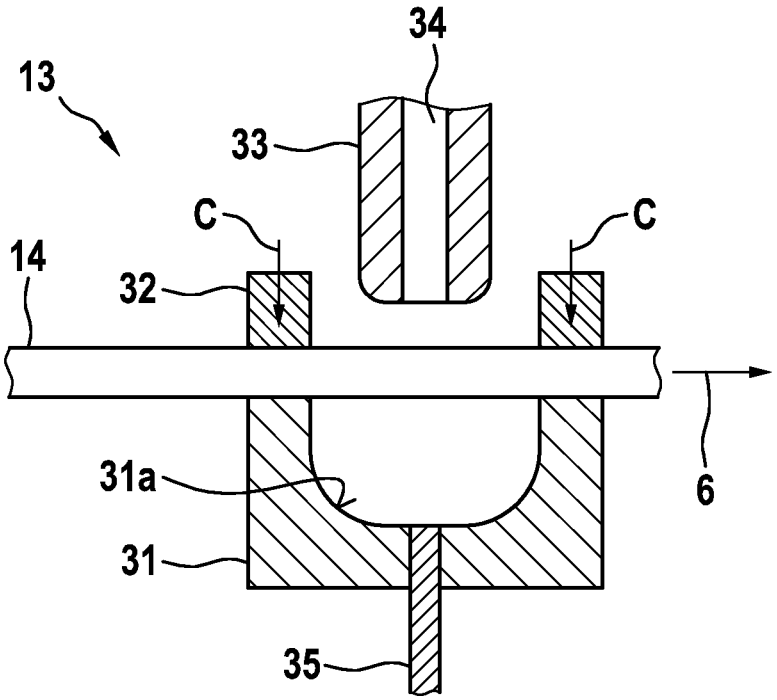
Figure 5:
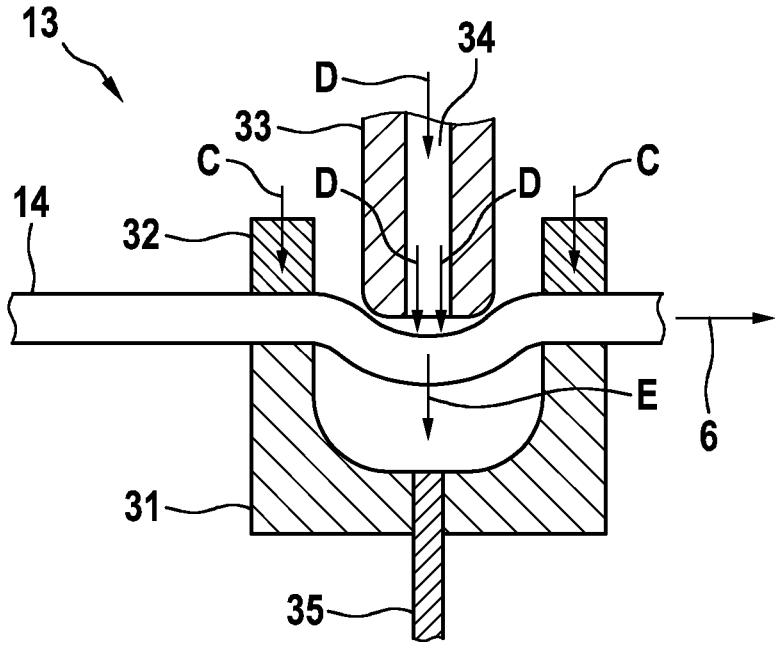
Figure 6:
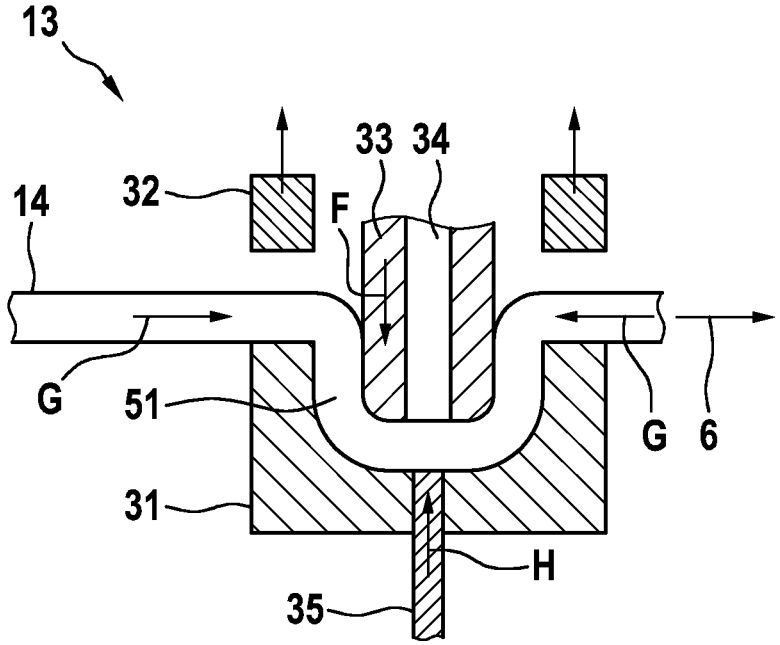

The molding means 13 is shown in detail in FIGS. 4 to 6. The molding means comprises a die 31 and a holding-down means 32. Furthermore, the molding means 13 comprises a punch 33, with an air duct 34 passing through the punch 33, and a removing device in the form of an ejector 35.

Furthermore, a control unit 7 is provided which is set up to control the molding means 13.

As can also be seen from FIG. 1, the packaging machine 100 further comprises a filling device, indicated schematically by the arrow 16 in FIG. 1, which fills an item to be packaged into the molded indentation 53 in the packaging body 51. The filled indentation 53 is then covered by the cover web of the cover roll web 20 and sealed with the molded packaging body 51 in a sealing station 17. The sealed packaging 5 is then punched out in a separating station 18 and the packaging thus produced is transported away in the direction of the arrow 19.

The method for producing a packaging body 51 from a paper material, comprising an indentation 53 for receiving an item to be packaged, is described in detail below. The method comprises the steps of pre-tensioning the web material 14 by means of the pre-tensioning device 3, which is shown in FIGS. 2 and 3. As indicated by the drive arrows A and B of the two rollers 3*c*, 3*d*, the web material 14 can be transported through these rollers. For pre-tensioning, the web material 14 is clamped by means of the lateral clamping jaws 3*a* and 3*b* and the two rollers 3*c* and 3*d* of the tension roller means 36 are driven briefly such that the web material 14 is pre-tensioned between the pull roller device and the clamping jaws.

This is followed by a step of fixing the tensioned web material 14 between the holding-down means 32 and the die 31. As can be seen from FIG. 4, the die 31 has a hollow mold 31*a* which corresponds to the three-dimensional shape of the packaging body to be created later. The clamping is shown by the arrows C in FIG. 4.

The web material 14 thus pre-tensioned and clamped is molded in the next step. Here, the indentation 53 is formed in the web material 14 in two steps. In the first step, pre-molding is carried out by means of compressed air, which is supplied via the air duct 34 (arrows D). This is shown in FIG. 5. This results in a first deformation of the web material 14, which is indicated by the arrow E in FIG. 5.

In a next step, final molding is carried out by moving the punch 33 in the direction of the arrow F (see FIG. 6). The holding-down means 32, which in the pre-molding step still clamped the web material 14 between the holding-down means 32 itself and the die 31, is moved in the opposite direction in order to stop the clamping process. As a result, web material 14 can be fed into the die during the final molding step, which is indicated by the arrows G in FIG. 6.

A fine molding can then be carried out, for example for embossing fine structures or the like. For this purpose, compressed air is preferably supplied under high pressure via the air duct 34 in order to carry out the embossing step. It should be noted, however, that the embossing step is optionally provided here.

In the last step, the molded packaging body 51 still has to be removed from the die 31. For this purpose, a removing device in the form of the ejector 35 is provided, which is guided vertically upward into the hollow mold of the die and can thus eject the molded indentation from the die (arrow H in FIG. 6).

The web material 14 is then transported further, wherein the rollers of the tension roller means are able to be moved away to avoid damage to the molded indentation.

It should be noted that the further transport can also be supported by the clamping jaws 3*a* and 3*b* of the pre-tensioning device.

It should also be noted that the pre-tensioning means can also stretch the web material 14 in addition to smoothing before the actual molding step. The stretching can be carried out by means of the tension roller means and/or by means of the clamping jaws.

It should also be noted that, instead of the compressed air, a negative pressure or a vacuum can, of course, also be used to mold the web material 14. A vacuum connection can be integrated into the die 31, for example.

It should also be noted that the produced packaging body can also be removed from the mold pneumatically, for example.

The invention claimed is:

1. A method for producing a packaging body (51) from a web material that comprises paper, wherein the packaging body (51) comprises an indentation (53) for receiving an item to be packaged, said method comprising the steps of:

feeding the web material in a transport direction;

pre-tensioning the web material (14);

fixing the web material (14) between a holding-down means (32) and a die (31), molding the indentation (53) in the web material (14) using a molding device and the die;

removing the molded indentation (53) from the die (31);

wherein the pre-tensioning step is carried out by clamping jaws (3*a*, 3*b*) arranged laterally on the web material and a tension roller arrangement (36) having two rollers (3*c*, 3*d*), wherein the web material (14) is passed between the two rollers (3*c*, 3*d*); and wherein the tension roller arrangement having two rollers is downstream of the molding device and the die in the transport direction.

2. The method according to claim 1, wherein the clamping jaws (3*a*, 3*b*) are also used for transporting the web material (14).

3. The method according to claim 1, wherein a step of stretching the pre-tensioned web material (14) is carried out by the clamping jaws (3*a*, 3*b*) and the tension roller arrangement (36).

4. A device for producing a packaging body (51) having an indentation (53) for receiving an item to be packaged from a web material (14) which comprises paper, comprising:

a device for feeding the web material in a transport direction;

a pre-tensioning device (3);

a molding device (13) having a die (31), a holding-down device (32), a pneumatic device for generating a pneumatic molding force, and a removing device for removing the molded indentation from the die;

wherein the pre-tensioning device comprises clamping jaws (3*a*, 3*b*) and a tension roller arrangement having at least two rollers (3*c*, 3*d*); and wherein the tension roller arrangement having at least two rollers is downstream of the molding device and the die in the transport direction.

5. The device according to claim 4, wherein the molding device (13) also has a punch (33).

6. The device of claim 5, wherein the punch (33) has an air duct (34).

7. The device according to claim 5, also comprising a control unit (7) which is set up to bring the holding-down device (32) into a position in which web material (14) can be fed into the die (31) during a final molding step.

8. The device according to claim 4, also comprising a control unit (7) which is set up to bring the holding-down device (32) into a position in which web material (14) can be fed into the die (31) during a final molding step.

9. A packaging machine comprising a device according to claim 4.

* * * * *